US007380486B1

(12) United States Patent
Bean

(10) Patent No.: US 7,380,486 B1
(45) Date of Patent: Jun. 3, 2008

(54) METHOD AND APPARATUS FOR SUPPORTING A SHOTGUN

(75) Inventor: Ron M Bean, Cedar Rapids, IA (US)

(73) Assignee: Hunter's Specialties, Inc., Cedar Rapids, IA (US)

( * ) Notice: Subject to any disclaimer, the term of this patent is extended or adjusted under 35 U.S.C. 154(b) by 327 days.

(21) Appl. No.: 11/160,304

(22) Filed: Jun. 17, 2005

(51) Int. Cl.
*F41A 23/08* (2006.01)

(52) U.S. Cl. ..... 89/37.04; 42/94

(58) Field of Classification Search ..... 42/94; 89/40.06, 37.04, 40.05
See application file for complete search history.

(56) References Cited

U.S. PATENT DOCUMENTS

| | | | | |
|---|---|---|---|---|
| 879,052 | A * | 2/1908 | Jeranek | 89/40.06 |
| 1,295,688 | A | 2/1919 | Butler | |
| 1,382,409 | A | 6/1921 | Butler | |
| 3,632,073 | A * | 1/1972 | Nakatani | 248/169 |
| 4,345,398 | A | 8/1982 | Pickett | |
| 5,029,407 | A | 7/1991 | Kirkpatrick | |
| 5,345,706 | A | 9/1994 | Brown | |
| 5,711,103 | A | 1/1998 | Keng | |
| 5,903,995 | A | 5/1999 | Brubach | |
| D411,280 | S | 6/1999 | Van Ek et al. | |
| 5,930,931 | A * | 8/1999 | Watson | 42/94 |
| 6,289,622 | B1 | 9/2001 | Desch, Jr. et al. | |
| 6,487,807 | B1 * | 12/2002 | Kopman et al. | 42/94 |
| 7,111,424 | B1 * | 9/2006 | Moody et al. | 42/72 |

OTHER PUBLICATIONS

See the "Background of Invention" section on pp. 1-2 in the specification of this patent application.
Turkey Hunter's Shotgun Rest Lazy Leg front and reverse sides of packaging insert, Lazy Leg, 463 Jack Smith Road, Dunlap, TN 37327. 2 pages, no date.
Six web pages from www.bipodshootingsticks.com showing BiPod Shooting Sticks in various positions. 6 pages, no date.
Article entitled "Turkey hunting lessons learned in 2002", by Terry Madewell, printed Sep. 12, 2005 from website CLARENDON TODAY.COM. 2 pages.

* cited by examiner

*Primary Examiner*—Stephen M Johnson
(74) *Attorney, Agent, or Firm*—Simmons Perrine PLC

(57) ABSTRACT

A shotgun shooting stick comprising an adjustable length hollow pole having a pair of retractable legs stored therein when not in use and first and second connectors to couple the hollow pole in a parallel configuration underneath a barrel of a shotgun.

7 Claims, 6 Drawing Sheets

METHOD AND APPARATUS FOR SUPPORTING A SHOTGUN

FIELD OF THE INVENTION

The present invention generally relates to hunting accessories, and more particularly relates to hunting shooting sticks, and even more particularly relates to methods and systems for supporting a shotgun while hunting.

BACKGROUND OF THE INVENTION

For years, hunters have appreciated that having an aid attached to the gun for stabilizing the gun while shooting is often convenient and quite beneficial.

One type of shooting aid that has been used in the past is a telescopic monopod shooting stick which is attached to the barrel of the shotgun near the forearm and pivots forward for storage and backward for shooting. This device is adjustable in length via the telescopic pole and in orientation, by lockable pivot.

While this device has significant advantages, it has several drawbacks. One problem with this design is that it has only a single point of contact with the ground, which allows the gun to easily tip in any direction, even if it is not intended. Lateral stability of the gun is important in many situations. Additionally, it is held onto a gun's barrel by two clamping sleeve halves which are held together by a screw. The retention of the pole in the stowed position is by a screw which limits pivoting of the pole in any direction. With such a design, the shooting stick is exposed to loss if either of the sleeve half retaining screws were to become loose so as to allow the sleeve halves to separate enough to allow the barrel to slip through or the pivot screw were to fall out. This could be a problem if the hunter is carrying the gun and the attached shooting stick via a sling where the shooting stick could become loose and completely fall off. Additionally, this design has only a single point of contact with the ground which allows the gun to easily tip in any direction.

Consequently, there exists a need for improved methods and systems for supporting a shotgun in an efficient manner.

SUMMARY OF THE INVENTION

It is an object of one embodiment of the present invention to provide a system and method for supporting a shotgun in an efficient manner.

It is a feature of one embodiment of the present invention to utilize a secure slide-on or snap-on attachment with the barrel.

It is another feature of one embodiment of the present invention to provide a stowable multi-point ground-engaging structure.

It is another feature of one embodiment of the present invention to utilize a forward friction clip to positively hold the shooting stick in the stowed position and to redundantly hold the shooting stick to the gun barrel.

It is an advantage of the present invention to achieve improved efficiency in supporting a shotgun while shooting.

The present invention is an apparatus and method for supporting a shotgun while shooting, which is designed to satisfy the aforementioned needs, provide the previously stated objects, include the above-listed features, and achieve the already articulated advantages. The present invention is carried out in a "lateral stability loss-less" manner in the sense that the ability for the gun to tip over sideways has been greatly reduced. The present invention is also carried out in a "risk of loss-less" manner in a sense that the risk of the shooting stick from falling off the gun while carrying it in a stowed position has been greatly reduced.

Accordingly, the present invention is a system and method including a monopod shooting stick with multiple points of contact with the ground, which is attached to a shotgun with multiple secure means of attachment.

BRIEF DESCRIPTION OF THE DRAWINGS

The invention may be more fully understood by reading the following description of the preferred embodiments of the invention, in conjunction with the appended drawings wherein.

DETAILED DESCRIPTION

Figure 1:
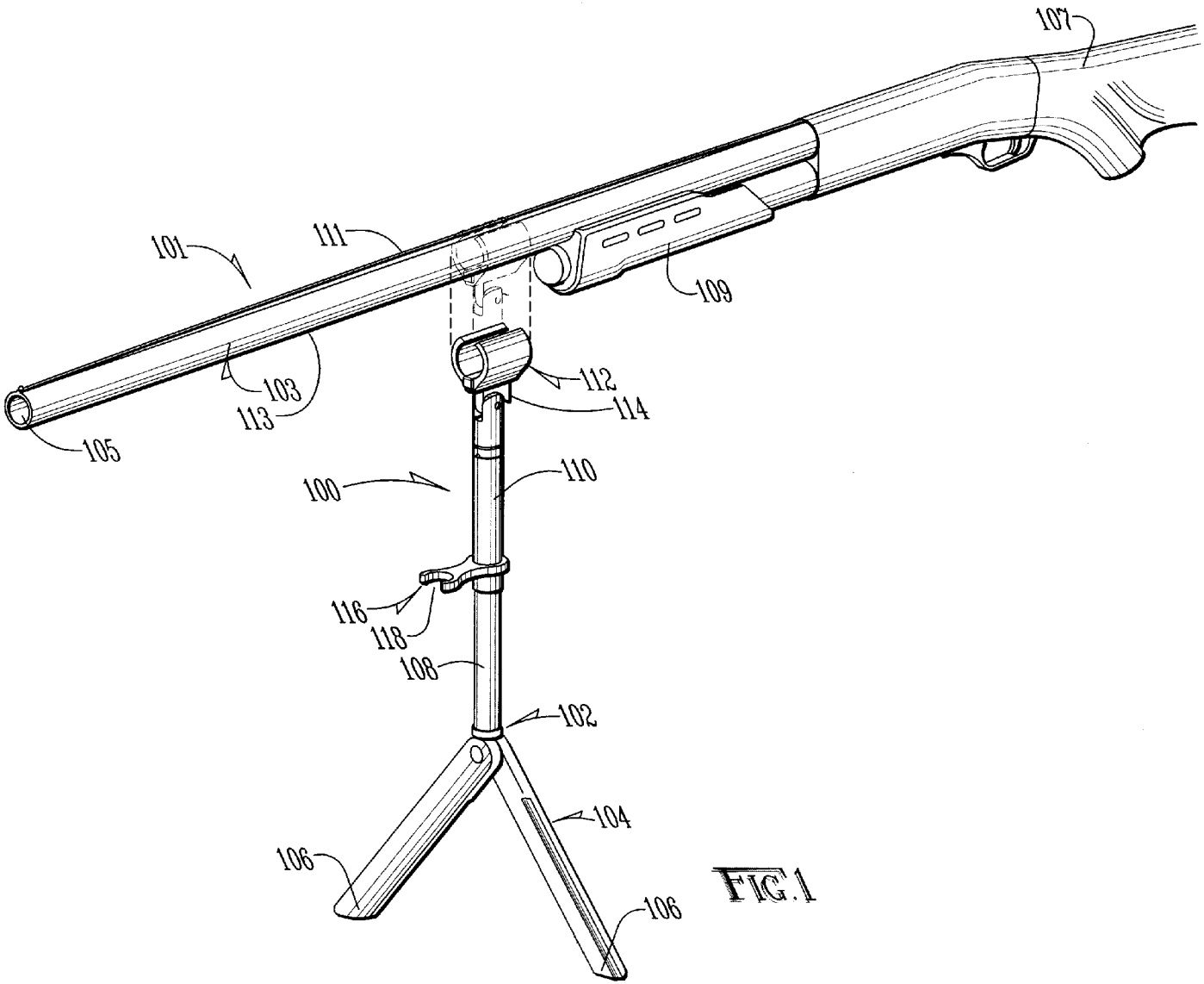
FIG. 1 is an exploded perspective view of a shooting stick and shotgun combination.

Now referring to the drawings, where like numerals refer to like matter throughout, and more particularly to FIG. 1, which shows an exploded view of the shooting stick assembly 100 and shotgun 101 combination of the present invention. The dotted lines show that the placement of the shooting stick barrel-engaging member 112 must be forward of the shotgun forearm 109. Other locations for connection may be used as well. Shooting stick barrel-engaging member 112 couples by either snapping the shooting stick barrel-engaging member 112 to the shotgun barrel bottom side 113, or by sliding the shooting stick barrel-engaging member 112 over the shotgun muzzle 105 and down the shotgun barrel 103. If shooting stick barrel-engaging member 112 snaps on, it may be made of a rugged resilient material, such as polypropylene or other suitable materials. If the shooting stick barrel-engaging member 112 slides over the shotgun muzzle 105, it can be made of any rugged material, including, but not limited to steel, aluminum, or alloys, etc. The shotgun 101 is shown having a shotgun stock 107, but it could be used with shotguns not having a stock or with shotguns having detachable stocks.

Shooting stick assembly 100 has an upper hollow tube 110 and a lower hollow tube 108 which collapses or slides in and out of the upper hollow tube 110. Numerous types of connectors to permit the length of the combined upper hollow tube 110 and lower hollow tube 108 to vary infinitely could be used. Such well-known connectors or sliding latches are used in tripods, trekking poles, and many other adjustable length poles. While the shooting stick assembly 100 is shown here with just an upper hollow tube 110 and a lower hollow tube 108, it should be understood that three or more segments could be used, depending upon the desired length when fully extended, and the desired length when fully collapsed.

The shooting stick assembly 100 is capable of both pivoting and swiveling for ease in aiming the shotgun while the shooting stick assembly 100 is being used. Swivel pivoting section 114 can be a simple swivel in combination with a simple hinge which pivots around a pin. Shooting stick barrel-engaging member 112 is shown near the shotgun forearm 109, so that for storage, it can be collapsed and then pivoted forward and held to the shotgun barrel 103 by the shooting stick storage retention clip 116, which couples to the shotgun barrel 103 via the shooting stick storage retention clip barrel-engaging portion 118.

During use for supporting the shotgun 101 and aiming the shotgun 101, the lower hollow tube 108 is shown having spring-loaded legs 104 which can be deployed from a retracted position from within lower hollow tube 108. Spring-loaded legs 104 are biased by a spring (FIG. 7) to splay and form a "V"-shaped base having leg bottom ends 106 which contact the ground or other surface from which the shotgun 101 is being supported. Spring-loaded legs 104 can be pivoted back together and pushed inside the lower hollow tube 108 for storage. When the shooting stick assembly 100 is fully collapsed, it can be folded up and held under the shotgun barrel 103.

Figure 2:
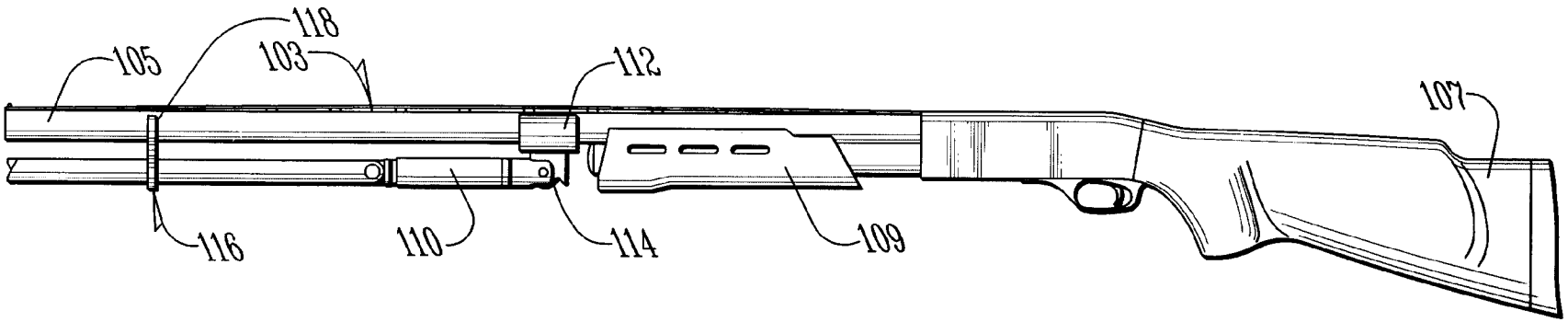
FIG. 2 is a side view of the shooting stick attached to the shotgun of FIG. 1.

Now referring to FIG. 2, there is shown the shooting stick assembly 100 and shotgun 101 combination of the present invention in such a stowed position. The shooting stick storage retention clip barrel-engaging portion 118 clips around a bottom portion of the shotgun barrel 103 so as to hold it out of the line of sight along shotgun barrel top side 111, but still in a handy and ready-to-be deployed configuration.

Ideally, the shooting stick assembly 100 will not extend beyond the shotgun muzzle 105 when the shooting stick assembly 100 is fully collapsed. While the attachment of shooting stick assembly 100 is shown to the shotgun barrel bottom side 113, it could be attached to a magazine tube (not shown) or other structure found under the shotgun barrel bottom side 113. Shooting stick assembly 100 is shown as being attached near the shotgun forearm 109 and pivoting forward toward the shotgun muzzle 105. Shooting stick assembly 100 could be mounted nearer the shotgun muzzle 105 and folded or pivoted backward for storage.

Figure 3:
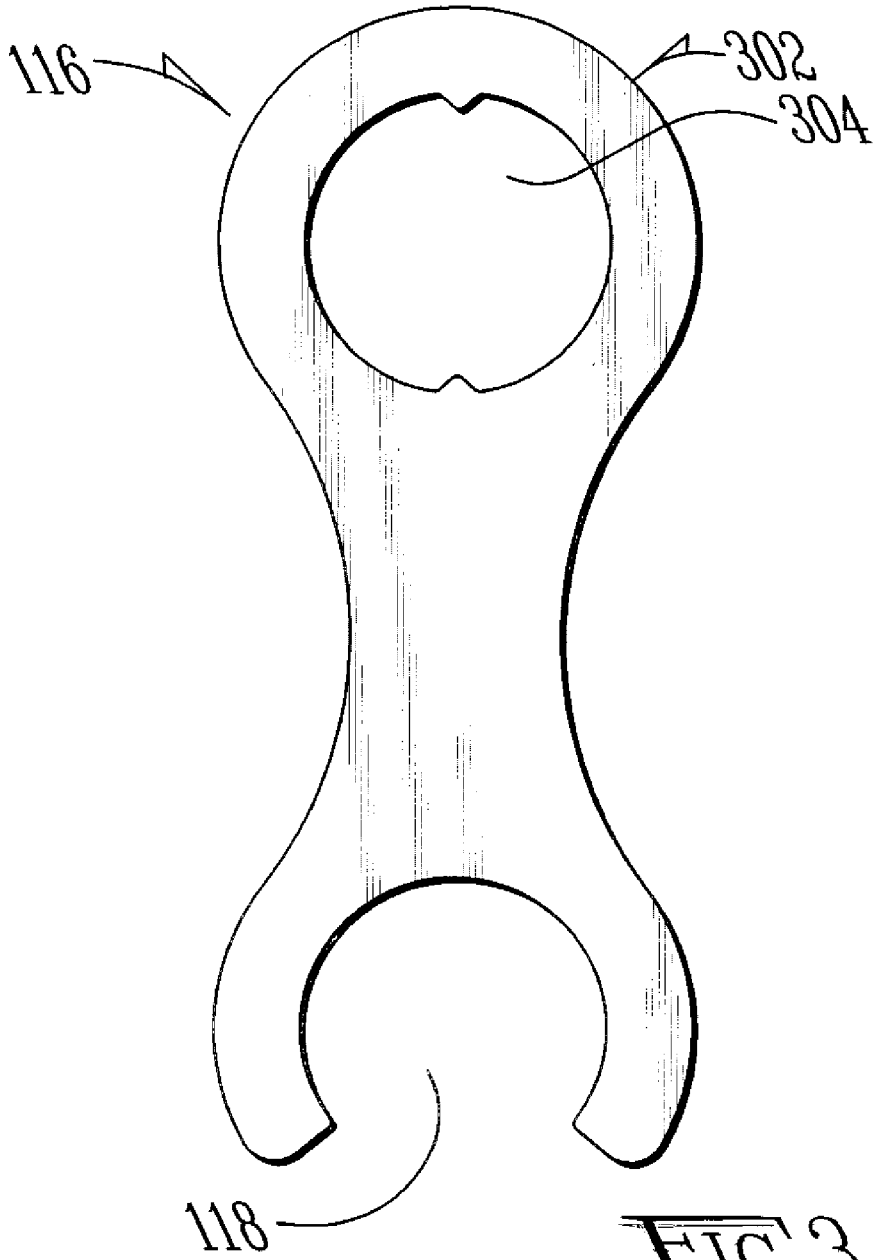
FIG. 3 is a close-up plan view of the shooting stick storage retention clip of FIGS. 1 and 2.

Now referring to FIG. 3, there is shown a shooting stick storage retention clip 116 with a shooting stick storage retention clip barrel-engaging portion 118 and shooting stick storage retention clip stick-engaging portion 302 with a shooting stick storage retention clip stick-receiving orifice 304 therein. Shooting stick storage retention clip barrel-engaging portion 118 may be sized and configured to securely snap over a shotgun barrel bottom side 113 while still permitting to be released with applied pressure.

Figure 4:
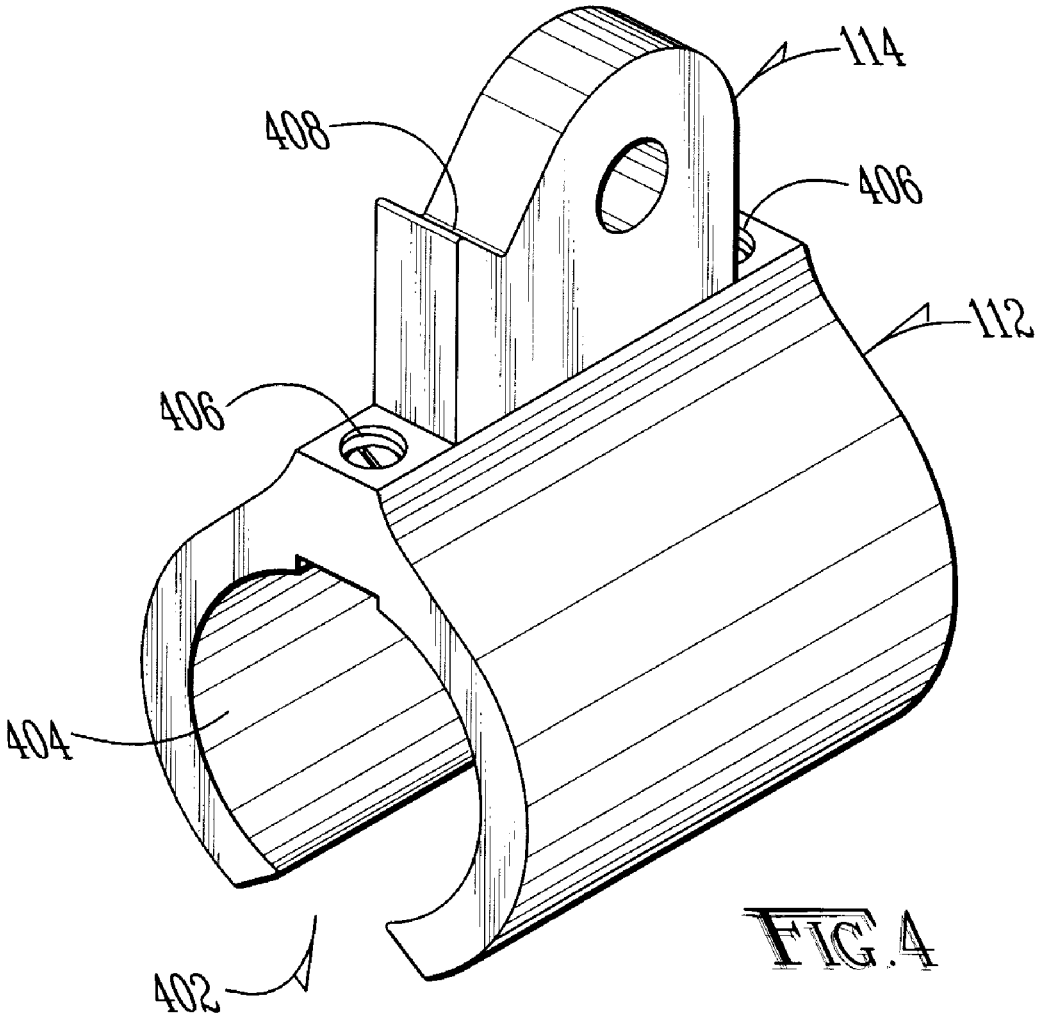
FIG. 4 is a close-up perspective view of the shooting stick barrel-engaging member of FIGS. 1 and 2.

Now referring to FIG. 4, shooting stick barrel-engaging member 112 is shown in a close-up perspective view. Shooting stick barrel-engaging member 112 is shown having a shotgun barrel-engaging member top end 402 which is open and a shotgun barrel-engaging member barrel-receiving void 404. Shotgun barrel-engaging member top end 402 could be enclosed so that the shooting stick barrel-engaging member 112 completely encircles a portion of the shotgun barrel 103. In such cases, shooting stick barrel-engaging member 112 would need to be slid over the shotgun muzzle 105 and then slid down the shotgun barrel 103 to the desired point of attachment. Shooting stick barrel-engaging member 112 can be held firmly in place by shotgun barrel-engaging member set screws 406 or the like. A thin protective material such as rubber, plastic or leather may be inserted between the shooting stick barrel-engaging member 112 and the shotgun barrel 103 to enhance the firmness of the connection therebetween and to limit scratching of the shotgun barrel 103. Stick pivot limiting structural feature 408 is shown on swivel pivoting section 114 mating section of shooting stick barrel-engaging member 112.

Figure 5:
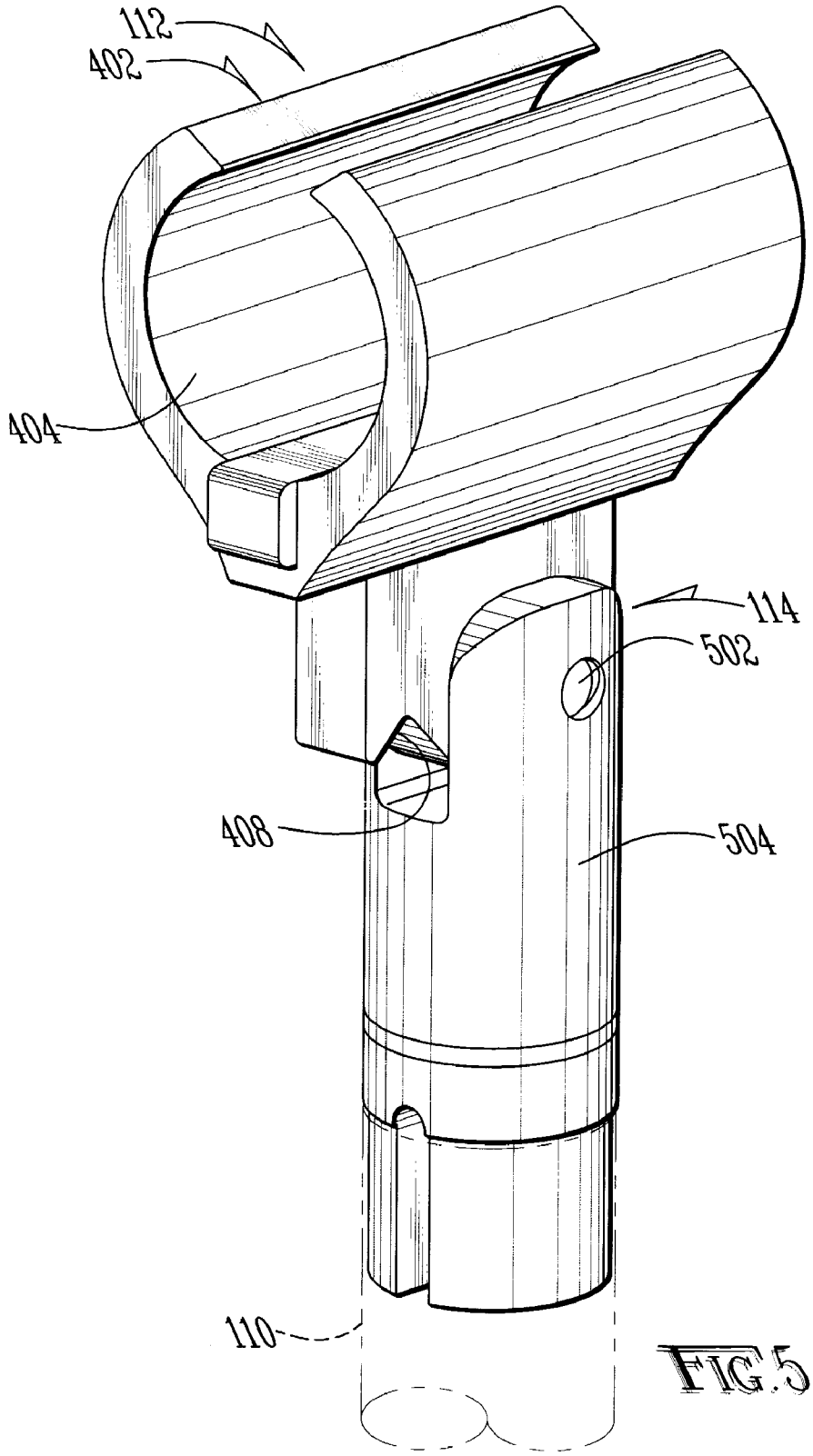
FIG. 5 is a close-up perspective view of the shooting stick barrel-engaging member of FIG. 4 and the swivel pivot end of the upper hollow tube of FIGS. 1 and 2.

Now referring to FIG. 5, there is shown a combination of shooting stick barrel-engaging member 112, swivel pivoting section 114 and upper hollow tube 110. Swivel pivoting section 114 is shown having a pivot pin 502 and a swivel pivot end 504. Stick pivot limiting structural feature 408 is shown to limit the pivoting of the shooting stick barrel-engaging member 112 counter-clockwise. Swivel pivoting section 114 may pivot around pivot pin 502, and it may swivel around a separate swivel or through the attachment with upper hollow tube 110.

Figure 6:
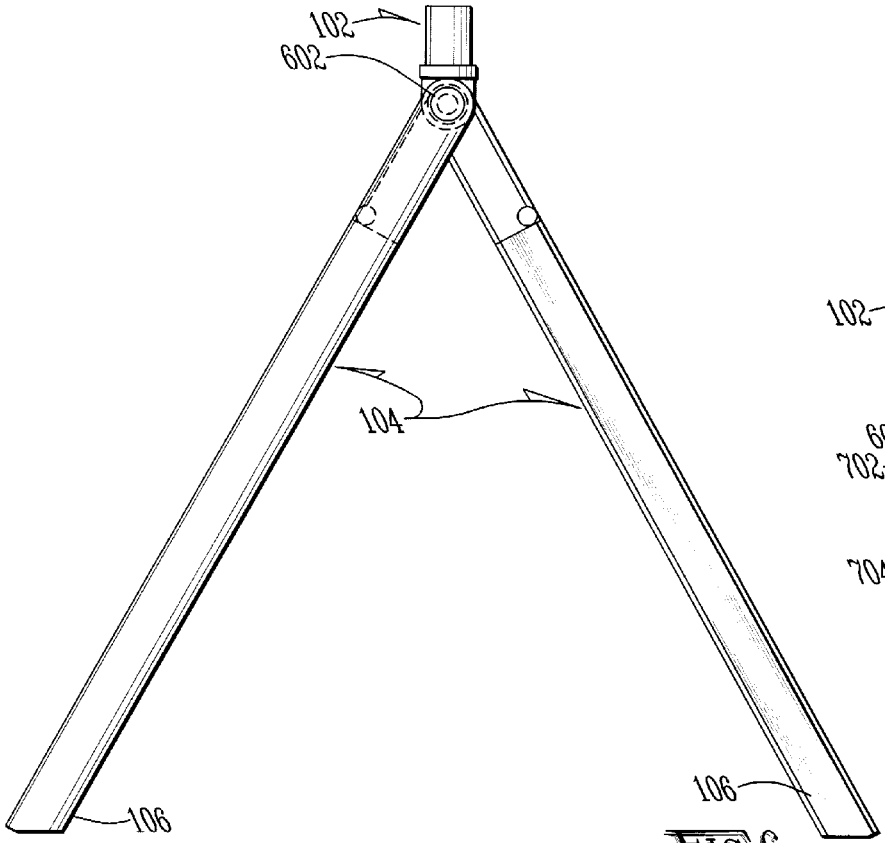
FIG. 6 is a close-up side view of the spring-loaded legs of FIGS. 1 and 2 shown in a splayed orientation.
Figure 7:
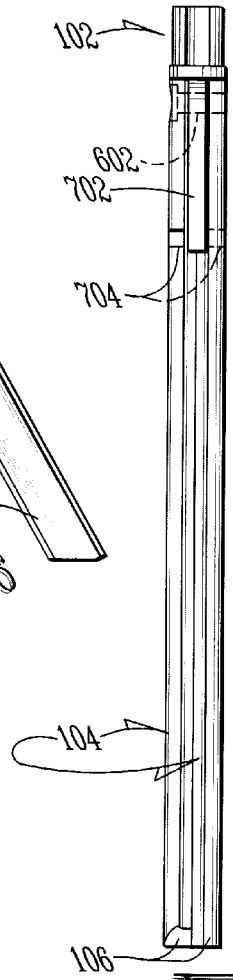
FIG. 7 is a close-up edge view of the spring-loaded legs of FIGS. 1, 2 and 6 in a collapsed configuration prior to retraction.

Now referring to FIG. 6, there is shown a close-up side view of the spring-loaded legs 104 in a splayed configuration. Spring-loaded legs 104 pivot around spring-loaded leg pivot pin 602 and can be pushed back together as shown in FIG. 7, which shows an edge view of the spring-loaded legs 104 with a spring-loaded leg spring 702 which rests between thinner upper portions of the spring-loaded legs 104 and mates with spring-loaded leg spring-engaging void 704 or other surface features. When the spring-loaded legs 104 are collapsed back over one another, they occupy a space small enough to be retracted back within the hollow tube bottom end 102 of lower hollow tube 108.

Throughout the description herein, the shotgun 101 is used as the example of the firearm. It should be understood that the shooting stick assembly 100 may be used with rifles, pistols or other firearms as well.

The materials for the components of shooting stick assembly 100 are preferably rugged and lightweight. Numerous well-known materials can be used to accomplish the present invention.

It is thought that the method and apparatus of the present invention will be understood from the foregoing description, and that it will be apparent that various changes may be made in the form, construct steps, and arrangement of the parts and steps thereof, without departing from the spirit and scope of the invention or sacrificing all of their material advantages. The form herein described is merely a preferred exemplary embodiment thereof.

What is claimed is:

1. A shooting stick comprising:

an elongated member having a barrel attachment end and an opposing end;

a barrel-engaging member coupled to the elongated member, so that the barrel-engaging member can swivel with respect to the opposing end;

the barrel-engaging member being configured to securely engage a first location at least at a bottom side of a barrel of a firearm;

a plurality of supporting legs operatively coupled to the elongated member to provide lateral stability;

the plurality of supporting legs configured to be capable of being deployed for use and then collapsed and held together to occupy a space smaller than a space defined by the elongated member;

wherein the elongated member has a hollow bottom end and the plurality of supporting legs are further configured to be capable of being at least partially retracted within the hollow bottom end;

where the plurality of supporting legs are spring loaded and biased toward a splayed configuration;

wherein the barrel-engaging member pivots with respect to the elongated member; and a shooting stick storage retention clip operatively coupled to the elongated member and configured to be capable of selectively retaining the opposite end of the elongated member in close proximity to a section of the barrel, so that the elongated member is parallel with the barrel.

2. The shooting stick of claim 1 wherein the elongated member is a telescoping plurality of nested hollow tubes.

3. The shooting stick of claim 2 wherein the barrel-engaging member is held onto the barrel by a friction fit.

4. A shooting stick comprising:

an elongated hollow member having a first firearm attachment end and an opposing collapsible leg end;

a firearm engaging member pivotally and swivelably coupled to first firearm attachment end;

the firearm-engaging member being configured to securely engage a first firearm location on a firearm;

a plurality of supporting legs operatively coupled to the hollow elongated member to provide lateral stability when deployed and a spring biasing at least one of the plurality of supporting legs into a splayed configuration;

the plurality of supporting legs configured to be capable of being deployed for use and then collapsed and held together and retracted to occupy a space within the hollow elongated member; and a storage retention clip attached to the hollow elongated member and selectively operatively coupled to the firearm at a second location on the firearm;

wherein the first firearm location is a location on a barrel of the firearm closer to a forearm of the firearm than a muzzle of a firearm, and the second firearm location is a location on the barrel which is closer to the muzzle than to the forearm.

5. The shooting stick of claim 4 wherein each of the plurality of supporting legs are spring loaded and biased toward being splayed with respect to another of said plurality of supporting legs.

6. The shooting stick of claim 4 wherein the storage retention clip is configured to attach to the barrel by being pressed on, causing a spreading of members and then a relaxation of members to grasp the barrel.

7. A shooting stick comprising:

a first member;

means for coupling the first member to a shotgun, so as to allow the first member to pivot and swivel with respect to the shotgun;

means for adjusting a length of the first member;

means for storing inside the first member, two legs operatively coupled to the first member for providing lateral stability to the first member; and, means for coupling the first member with a barrel of the shotgun, so that said first member is held in a parallel relationship with and adjacent to the barrel and said two legs are closer to a muzzle of the shotgun than is the means for coupling the first member to a shotgun.

* * * * *